United States Patent [19]

Kanzaka et al.

[11] 3,950,827

[45] Apr. 20, 1976

[54] SLIDER FOR ADJUSTABLE FASTENING DEVICE

[75] Inventors: Yoshihiro Kanzaka, Nyuzen; Tunetaka Aoki, Kamiichi, both of Japan

[73] Assignee: Yoshida Kogyo Kabushiki Kaisha, Japan

[22] Filed: Nov. 7, 1974

[21] Appl. No.: 521,863

[30] Foreign Application Priority Data

Nov. 17, 1973 Japan ..... 48-133051[U]

[52] U.S. Cl. ..... 24/206 B

[51] Int. Cl.[2] ..... A44B 19/00

[58] Field of Search ..... 24/227, 71 SK, 71 T, 24/71 ST, 206 B, 230 G, 265 R, 265 A, 265 SC; 2/221, 237

[56] References Cited

UNITED STATES PATENTS 2,441,377 5/1948 Taberlet ..... 24/206 B 3,305,906 2/1967 Patrick ..... 24/227

FOREIGN PATENTS OR APPLICATIONS 1,014,390 9/1964 United Kingdom ..... 24/227

*Primary Examiner*—Donald A. Griffin

*Attorney, Agent, or Firm*—Bucknam and Archer

[57] ABSTRACT

An adjustable fastening device comprises a slider and a rack which cooperate to adjustably fasten two parts of an article, or two separate articles, together. The slider has a pair of ears projecting laterally from the top wall of its body and at least partly elevated above the plane of the top wall. A separate anchoring member is provided which is to be placed over the ears and the intervening top wall portion via one of the article parts. The anchoring member includes a boss to be received in the interspace between the elevated ear portions via the article part, and a plurality of piercing fingers to be thrusted through the article part and to be clinched against the ears.

3 Claims, 6 Drawing Figures

SLIDER FOR ADJUSTABLE FASTENING DEVICE

BACKGROUND OF THE INVENTION

This invention relates generally to adjustable fastening devices, and in particular to an adjustable fastening device of the type comprising a rack and a slider, the latter being releasably lockable in any selected position on the former so that articles, or parts of an article, attached to these two major components of the device can be adjustably fastened to each other. The invention is more specifically directed to the improved slider designed to be firmly attached to a desired article.

The adjustable fastening devices of the type above defined have been extensively used on the waistbands of garments such as trousers, skirts and jackets to properly fit the same on the wearer. Heretofore, for attachment of the slider to the article with which the fastener is to be used, the slider has been provided with fingers extending upwardly from its body portion. These fingers are thrusted through a desired part of the article and are further inserted into and through respective apertures formed in a separate plate member. The fingers projecting out of the apertures in the plate member are clinched to hold the article part between the slider body and the plate member.

According to this conventional manner of attachment of the slider to the article part, the latter is caught only between the narrowly confined surfaces of the slider body and the plate member. Moreover, the opposed surfaces of the slider body and the plate member are generally flat so that they are usually unable to engage the article part with sufficient firmness. As a consequence, the slider of the prior art configuration has tended to lose its hold on the article part during use of the adjustable fastening device.

SUMMARY OF THE INVENTION

It is, therefore, among the objects of this invention to provide an improved slider for an adjustable fastening device which can be attached to an article so firmly that it will enable the device to remain in service for a significantly longer period of time than has been possible with the prior art slider of the above noted type.

Another object of the invention is to provide a slider which can be easily attached to an article in a minimum of time and labor.

With these objects in view and the other ancillary ones hereinafter set forth, this invention provides, in an adjustable fastening device of the type defined, a slider having a pair of ears projecting laterally from the top wall of its body. An anchoring member is provided separately to be placed over the ears and the intervening top wall portion via an article part to which the slider is to be attached. A plurality of piercing fingers extend downwardly from the anchoring member to pierce the article part and then to be bent over toward the back of the ears.

Preferably, the laterally projecting ears are each at least partly elevated above the plane of the top wall of the slider body, and the anchoring member has a downwardly projecting boss which serves to press the mid-portion of the article part down into the interspace between the elevated portions of the ears. In this manner the slider will be even more firmly anchored in position on the article.

The features which are believed to be novel and characteristic of this invention are set forth with particularity in the appended claims. The invention itself, however, both as to its construction and manner of functioning, together with the further objects and advantages thereof, will become apparent as the description proceeds, with reference had to the accompanying drawings in which like reference characters denote corresponding parts of the several views.

DESCRIPTION OF THE PREFERRED EMBODIMENTS

Figure 1:
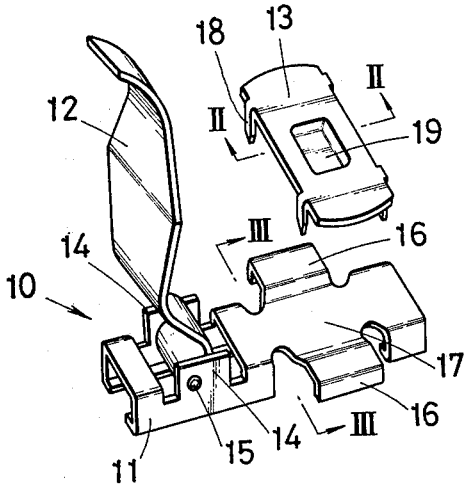
FIG. 1 is a perspective view of a slider for an adjustable fastening device constructed by way of a preferred embodiment of the invention, in which an anchoring member is shown disassembled from the slider body.

FIG. 1 of the drawings best represents the general configuration of the slider for an adjustable fastening device according to the invention. The illustrated slider 10 broadly comprises a body 11, a releasable locking or clamping member 12, and a separate anchoring member 13. The slider body 11 includes a pair of trunnions 14 which are apertured to rotatably receive the integral pintles 15 of the locking member 12.

Figure 3:
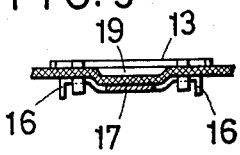
FIG. 3 is a sectional view taken along the plane of line III—III in FIG. 1, in which the slider is shown attached to a desired article part.

According to this invention, the slider body 11 is provided with a pair of ears 16 extending laterally from its top wall 17. As will be seen also from FIG. 3, at least portions of the ears 16 are elevated above the plane of the slider body top wall 17.

Figure 2:
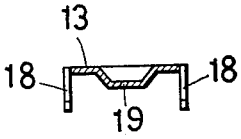
FIG. 2 is a sectional view taken along the plane of line II—II in FIG. 1.

As illustrated in FIGS. 1 and 2, the anchoring member 13 is generally in the form of a substantially rectangular plate, with a size sufficient to completely cover the ears 16 and the intervening portion of the top wall 17. The anchoring member includes two pairs of piercing fingers 18 extending right-angularly or downwardly therefrom, the piercing fingers being intended to be clinched against the ears 16 to fasten the anchoring member onto the slider body 11. A boss 19 is formed on the back or lower side of the anchoring member 13 so as to be received in the interspace between the elevated portions of the ears 16.

Figure 4:
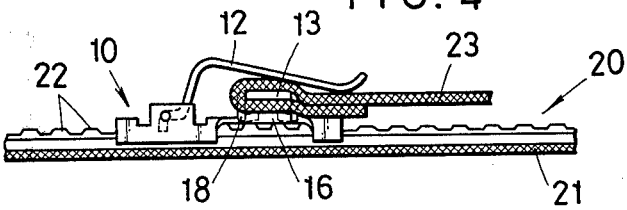
FIG. 4 is a side elevational view showing a mode of attachment of the slider shown in FIG. 1 to the article part.
Figure 5:
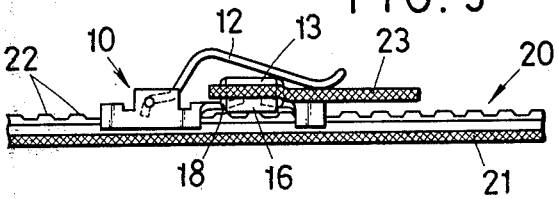
FIG. 5 is a view similar to FIG. 4 but showing an alternative mode of attachment of the slider to the article part.

The slider 10 configured as hereinbefore described according to the invention is to slide over a rack 20, FIGS. 4 and 5, that is sewn or otherwise attached to a part 21 of a garment or like article with which the adjustable fastening device is to be used. The rack 20 comprises a series of intersticed stops 22. When in the position shown in FIG. 4 or 5, the releasable locking member 12 on the slider body 11 engages the rack 20 between any two adjacent stops to secure the slider at any desired point thereon.

FIG. 4 is explanatory of a mode of attachment of the slider 10 according to the invention to another article part 23. As seen in the drawing, the end portion of the article part 23 is folded downwardly so as to enclose the separate anchoring member 13, and the pairs of piercing fingers 18 extending downwardly from the latter are thrusted into and through the fold of the article part. The anchoring member together with the folded article part is then placed in position over the slider body 11, and the piercing fingers projecting through the fold of the article part are succeedingly bent over toward the back or lower side of the ears 16 so that each pair of piercing fingers tightly embrace each ear. The positive anchorage of the slider 10 onto the desired article part 23 is thus completed.

Inasmuch as the slider 10 according to the invention includes the anchoring member 13 having the piercing fingers 18, it is also possible to thrust these fingers directly into the unfolded article part 23, as will be seen from a consideration of FIG. 5. The anchoring member may then be placed in position over the slider body 11 via the article part.

Whether the slider 10 is attached to the article part 23 in the manner shown in FIG. 4 or in FIG. 5, it will be appreciated that the article part is tightly held against the laterally extending ears 16 of the slider body 11 and is further partly depressed by the boss 19 of the anchoring member 13 into contact with the top wall of the slider body intervening between the ears. The article part can thus be held in close contact with a significantly greater surface area of the slider body than has been feasible heretofore.

Figure 6:
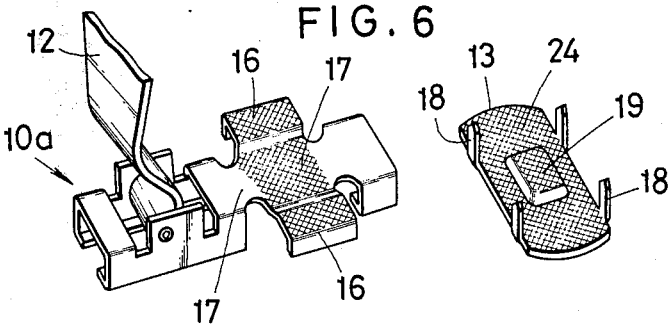
FIG. 6 is a view similar to FIG. 1 but showing another preferred embodiment of the invention.

FIG. 6 illustrates a slight modification of the preceding embodiment of the invention, in which the lower surface of the anchoring member 13 and the opposed upper surfaces of the ears 16 and of the intervening top wall portion are crosshatched with knurls 24 for non-slip contact with the article part 23 to be caught between these surfaces, thereby affording even more positive attachment of this modified slider 10*a* to the article part. Other structural and functional details of the slider 10*a* are exactly as above stated in connection with the slider 10 shown in FIG. 1.

Having thus described the several novel and useful features of the slider for adjustable fastening devices according to the invention, it is believed that the various objects for which it was designed have been fully accomplished. However, while the invention has been shown and described herein in terms of only a few of its various possible embodiments, certain additional modifications may well occur to those skilled in the art within the broad teaching hereof. The invention, therefore, should be construed broadly and in a manner comprehensive of all such modifications coming within the scope of the following claims.

What is claimed is:

1. In an adjustable fastening device of the type having a slider attached to a first part and slidable over a rack attached to a second part, said slider including a releasable locking member adapted to lock said slider in any selected position on said rack for adjustably fastening said first and second parts together, the improvement wherein said slider further comprises a body having a top wall, a pair of ears projecting laterally from said top wall of said body, a separate anchoring member placed over said ears and the portion of said top wall intervening therebetween via said first part, and a plurality of piercing fingers extending downwardly from said anchoring member to pierce said first part, said piercing fingers being clinched against said ears to secure said anchoring member to said body and hence to effect positive anchorage of said slider onto said first part.

2. The improvement as set forth in claim 1, wherein the lower surface of said anchoring member and the opposed upper surfaces of said ears and the top wall portion intervening therebetween are knurled for non-slip contact with said first part.

3. In an adjustable fastening device of the type having a slider attached to a first part and slidable over a rack attached to a second part, said slider including a releasable locking member adapted to lock said slider in any selected position on said rack for adjustably fastening said first and second parts together, the improvement wherein said slider further comprises a body having a top wall, a pair of ears projecting laterally from said top wall of said body, a separate anchoring member placed over said ears and the portion of said top wall intervening therebetween via said first part, and a plurality of piercing fingers extending downwardly from said anchoring member to pierce said first part, said piercing fingers being clinched against said ears to secure said anchoring member to said body and hence to effect positive anchoring of said slider onto said first part at least a portion of each of said ears being elevated above the plane of said top wall of said body, and said anchoring member including a boss projecting downwardly therefrom to be received in the interspace between said elevated portions of said ears via said first part.

* * * * *